US009144272B2

(12) United States Patent
Sharaby

(10) Patent No.: US 9,144,272 B2
(45) Date of Patent: Sep. 29, 2015

(54) INTELLIGENT BRACELET FOR ATTRACTING A BABY'S ATTENTION

(76) Inventor: Zvi Sharaby, Foshan (CN)

( * ) Notice: Subject to any disclaimer, the term of this patent is extended or adjusted under 35 U.S.C. 154(b) by 108 days.

(21) Appl. No.: 14/241,386

(22) PCT Filed: Jul. 17, 2012

(86) PCT No.: PCT/CN2012/078735

§ 371 (c)(1),
(2), (4) Date: Jun. 27, 2014

(87) PCT Pub. No.: WO2013/029437

PCT Pub. Date: Mar. 7, 2013

(65) Prior Publication Data

US 2014/0307913 A1 Oct. 16, 2014

(30) Foreign Application Priority Data

Aug. 26, 2011 (CN) ..... 2011 1 0248499

(51) Int. Cl.

| | |
|---|---|
| ***H04R 1/02*** | (2006.01) |
| ***A44C 5/00*** | (2006.01) |
| *H04R 9/06* | (2006.01) |
| *H04R 9/08* | (2006.01) |

(52) U.S. Cl.
CPC ..... *A44C 5/0007* (2013.01); *H04R 1/028* (2013.01)

(58) Field of Classification Search
CPC ..... B06R 11/0217; B06R 2011/0045; H04R 1/02; H04R 1/025; H04R 1/028; H04R 1/03; H04R 1/04; H04R 1/05; H04R 1/08; H04R 1/083; H04R 1/38; H04R 1/342; H04R 1/406; H04R 5/02; H04R 5/023; H04R 2201/021; H04R 2205/023; H04R 2205/021; H04R 2499/11; H04R 2499/15
USPC ..... 381/87, 91, 333, 334, 364; 24/3.1, 3.2
See application file for complete search history.

(56) References Cited

U.S. PATENT DOCUMENTS 7,618,260 B2 * 11/2009 Daniel et al. ..... 24/311
8,208,670 B2 * 6/2012 Wright ..... 381/334

(Continued)

FOREIGN PATENT DOCUMENTS

CN 2269750 Y 12/1997
CN 200980385 Y 11/2007

(Continued)

OTHER PUBLICATIONS

International Search Report of international application No. PCT/CN2012/078735, dated Nov. 8, 2012.

(Continued)

*Primary Examiner* — Brian Ensey
(74) *Attorney, Agent, or Firm* — J.C. Patents

(57) ABSTRACT

The present invention relates to an intelligent bracelet for attracting a baby's attention, and this bracelet comprises a circular main body, in which a microcomputer controlled circuit is provided, and an USB interface, a button, a loudspeaker, a microphone and a memory are connected by the microcomputer controlled circuit; the inner sidewall of the circular main body is surrounded by a plate jacket with protrusion, and the plate jacket has a jacket hole in its central part, which can be attached around any round item for self-fixation; and this bracelet has a phonating function. The intelligent bracelet of this invention is small in volume, convenient to carry and operate, and automatically-fixed; the bracelet can be directly attached around the baby's wrist; the plate jacket of the bracelet outer casing is suitable for babies' wrists of different sizes, and will not cause harm to the babies' skin; besides, the intelligent bracelet can be put on baby milk bottles of various types, which is convenient for baby to enjoy music when having milk, increasing the baby's attention when having milk, increasing their appetite, and allowing the baby to enjoy music when having milk to develop intelligence of the baby sooner.

10 Claims, 4 Drawing Sheets

(56) References Cited

U.S. PATENT DOCUMENTS

| | | | | |
|---|---|---|---|---|
| 2002/0025056 | A1* | 2/2002 | Fujita et al. | 381/364 |
| 2008/0005875 | A1 | 1/2008 | Friedman et al. | 24/578.15 |

FOREIGN PATENT DOCUMENTS

| | | | |
|---|---|---|---|
| CN | 201782138 | U | 4/2011 |
| CN | 201959223 | U | 9/2011 |
| CN | 202222568 | U | 5/2012 |
| CN | 202236260 | U | 5/2012 |
| DE | 3606818 | A1 | 9/1987 |
| JP | 07-236505 | | 9/1995 |

OTHER PUBLICATIONS

International Search Report of corresponing International PCT Application No. PCT/CN2012/078735, dated Nov. 8, 2012.

* cited by examiner

INTELLIGENT BRACELET FOR ATTRACTING A BABY'S ATTENTION

TECHNICAL FIELD

The present invention relates to the ornament arts, particularly relates to an intelligent bracelet for attracting a baby's attention, this bracelet is an intelligent bracelet, in which a microcomputer controlled generating device is provided, and in the inner ring of which one flexible jacket is provided to be attached around any round item for self-fixation, and this bracelet has a phonating function.

BACKGROUND TECHNOLOGY

Bracelet is a common ornament worn on wrist. While current bracelet is mainly used for decoration and seldom has other functions. With the improvement of people's living standard, people pay more and more attention to baby's antenatal training and 'early education. Now, people pay more and more attention to baby's antenatal training and early education, before a child is born, people generally tend to cultivate children's interest to music through fetal music, etc. After the child is born, the parents usually like playing the music or lullaby, etc that baby enjoys with CD(s). However, when taking baby out, because many baby items need be carried, such as a stroller, feeding bottles, water bottles, napkins and diaper etc., parents generally will not carry CD(s) etc. with them, and can't play songs that baby enjoys at any time. Baby's skin is relatively delicate, and design of articles used by the baby should be suitable to baby's characteristics. Therefore, requiring a novel portable intelligent bracelet, which is convenient for parents to carry around to cultivate the baby' interest to new things and cultivate their ability of initiatively thinking at any time.

SUMMARY OF THE INVENTION

The object of this invention is to provide an intelligent bracelet for attracting a baby's attention, and this bracelet is an intelligent bracelet, in which a microcomputer controlled generating device is provided; one flexible jacket is provided in its inner ring, and can be attached around any round item for self-fixation, and this bracelet has a phonating function thus attracting the baby's attention.

The object of the utility model is realized by the following technical solution: an intelligent bracelet for attracting a baby's attention, comprising a circular main body, in which a microcomputer controlled circuit is provided, and an USB interface, a button, a loudspeaker, a microphone and a memory are connected by the microcomputer control circuit; the inner ring sidewall of the circular main body is surrounded by a plate jacket with protrusion; the said plate jacket has a jacket hole in its central part, and the plate jacket is a plate jacket of elastic material with a thickness greater than 2 mm.

The elastic material plate is a silicone rubber plate.

The plate jacket comprises at least three arc-shaped protruding plates distributed evenly surrounding the inner sidewall of the circular main body.

The plate jacket comprises five arc-shaped protruding plates distributed evenly surrounding the inner sidewall of the circular main body.

The circular main body comprises a main body upper casing and a main body lower casing, and the joint part between the main body upper casing and the main body lower casing is provided with a card slot, and the main body upper casing and the main body lower casing snaps the plate jacket on the inner sidewall of the circular main body by the card slot.

A connector of the USB interface, a loudspeaker hole and a microphone hole are provided on outer ring wall of the circular main body respectively.

A display circuit is also connected on the microcomputer control circuit, and a digital display screen is also provided on the circular main body.

An earphone output circuit is also connected on the microcomputer control circuit, and an earphone jack is provided on the circular main body.

The button is a touch button, and a mounting opening of the touch button is provided on the circular main body.

The button is a protruding button.

Compared with the prior art, the present invention has the following advantages:

The intelligent bracelet of this invention is small in volume, convenient to carry and operate, and can be automatically-fixed; the intelligent bracelet can be directly attached around baby's wrist, and the protruded plate jacket of the bracelet outer casing is fit for baby's wrists of different sizes, and will not harm baby's skin. Besides, the intelligent bracelet can be attached around baby milk bottles of various types, which is convenient for the baby to enjoy music when having milk, increasing the baby's attention when having milk, increasing their appetite, and allowing the baby to enjoy music when having milk to develop intelligence of the baby sooner.

The intelligent bracelet of the present invention has both the playing function and the recording function; on the one hand, it can play a song, etc. that a baby enjoys at any time, and on the other hand, it can record the baby's various vocal changes at any time; we can record each growth of the baby at any time.

The intelligent bracelet of the present invention is convenient to use, and easy to switch between playing and recording, and even the older parents also can use it rapidly.

The intelligent bracelet of the present invention has both attractive appearance and utility functions.

The present invention will be further described below with reference to the following accompanying drawings and embodiments,

DESCRIPTION OF THE ACCOMPANYING DRAWINGS

DETAILED DESCRIPTION OF THE PREFERRED EMBODIMENTS

Embodiment 1

Figure 1:
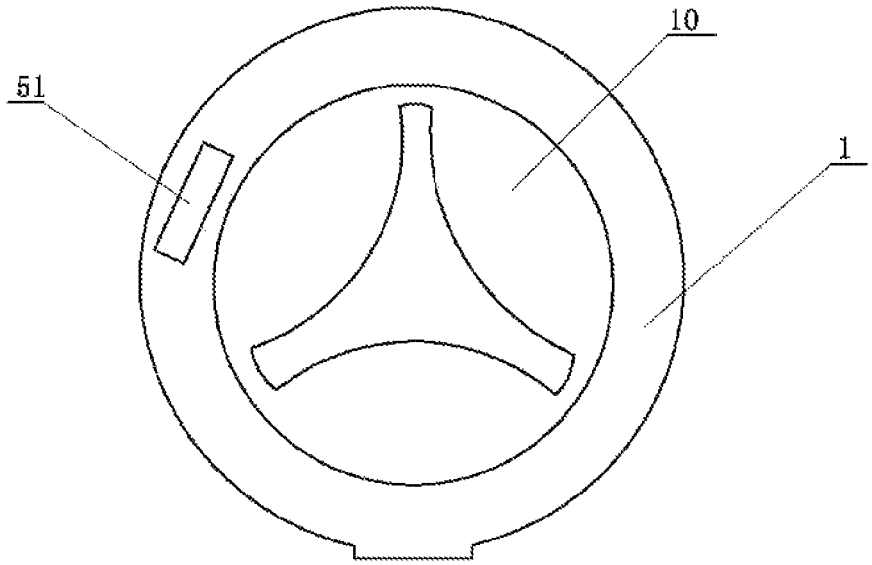
FIG. 1 is a front view schematic diagram of structure of the embodiment 1 of the present invention.

An intelligent bracelet for attracting a baby's attention, see FIG. 1-4, comprising a circular main body 1, in which a microcomputer control circuit 3 is provided; an USB interface 4, a button 5, a loudspeaker 6, a microphone 8 and a memory 7 are connected by the microcomputer control circuit; the inner sidewall of the circular main body is surrounded by a plate jacket 10 with protrusion, and the plate jacket is a plate jacket elastic material with a thickness greater than 2 mm.

Figure 3:
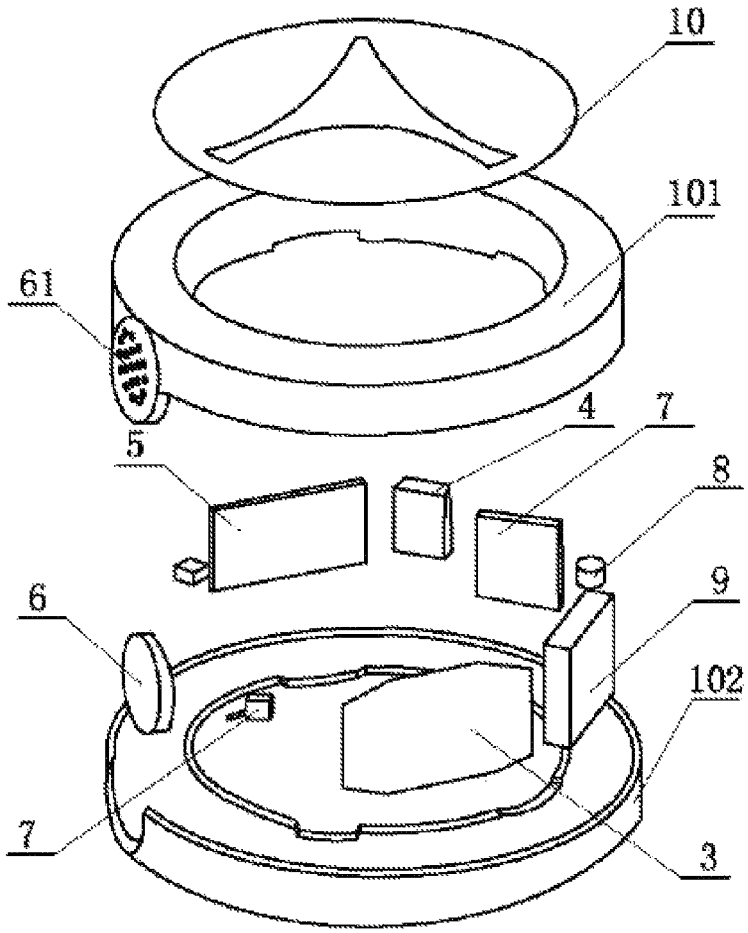
FIG. 3 is an exploded schematic diagram of structure of the embodiment 1 of the present invention.

See FIG. 3, the circular main body comprises a main body upper casing 101, a main body lower casing 102, the main body upper casing and the main body lower casing are connected, forming a cavity therebetween; the microcomputer control circuit is provided in the cavity. The manufacturing material of the circular main body can be rubbers, also can be plastics. The inner sidewall of the circular main body is surrounded by the plate jacket; the object of providing a jacket hole in the middle of the plate jacket is to put the intelligent bracelet on baby's wrist or feeding bottle, and the plate jacket is fit to wrists of different sizes and feeding bottles of various types; the plate jacket should have a certain thickness, as if thickness is too thin, it may result in a low intensity of the plate jacket; when the intelligent bracelet is attached around a slightly larger object, the plate jacket will not shrink but will present crispate, therefore the plate jacket must have a certain thickness, and the thickness of the plate jacket should at least be greater than 2 mm, and the thickness of a preferred plate jacket is 3 mm.

The present embodiment can control operations of functions of the intelligent bracelet, such as music playing, song selecting, forward and backward, and recording by pressing the button.

The intelligent bracelet also comprises a battery 9, and the battery can be a rechargeable lithium battery, or other rechargeable batteries.

See FIG. 3, the microcomputer control circuit mainly comprises a main control circuit (MCU), a USB circuit, a recording circuit (MIC), a power amplifier (PA), a memory (TF CARD), a function switch circuit (KEY) and a power management system circuit (PMU).

The main control circuit MCU is designed by adopting an integrated chip available to upgrade and update software, and can upgrade product functions at any time through a USB data line as required; the USB circuit has charging and data transmission functions, and is connected with the USB interface; the recording circuit MIC is designed by adopting a high-fidelity circuit, can realize recording and saving functions by pressing one button and connect with the microphone; the power amplifier PA is designed by adopting a D amplifier, can reach the best acoustical quality and connect with the loudspeaker; the memory adopts a TF memory or a FLASH card, can configure the required memory size according to client's demand; the function switch circuit (KEY) is controlled by adopting a touch button, can optionally set and change function control and state of the button as requirement; both the voltage output by power and switch of the power management system circuit (PMU) can be automatically controlled by software, which can play the role of protecting the circuit.

The USB interface, the button, the loudspeaker, the memory, the microphone and the battery all belong to the prior art, and all can be commercially available.

When in use, we can charge battery via the USB interface, and also can carry out a data transmission via the USB interface. Specifically, the intelligent bracelet of the present invention connects to a computer USB port by the USB interface, transmits data to the microcomputer control processor, and the microcomputer control processor transmits the data having been processed to the memory.

When playing music with the intelligent bracelet of this embodiment, the microcomputer controlled processor reads music file data from the memory, and outputs music by the loudspeaker after being processed by the microcomputer control processor. When recording with the intelligent bracelet of this embodiment, the microphone transmits a voice to the microcomputer controlled processor, and then stores the voice in the memory after being processed by the microcomputer control processor.

Embodiment 2

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

The protruded plate jacket is made of an elastic material with contractibility, and the elastic material with contractibility should be a nontoxic material suitable for baby products, and specifically, the elastic material can be rubbers, or soft PVC plastics; in this embodiment, the elastic material plate is a silicone rubber plate.

Embodiment 3

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

Figure 2:
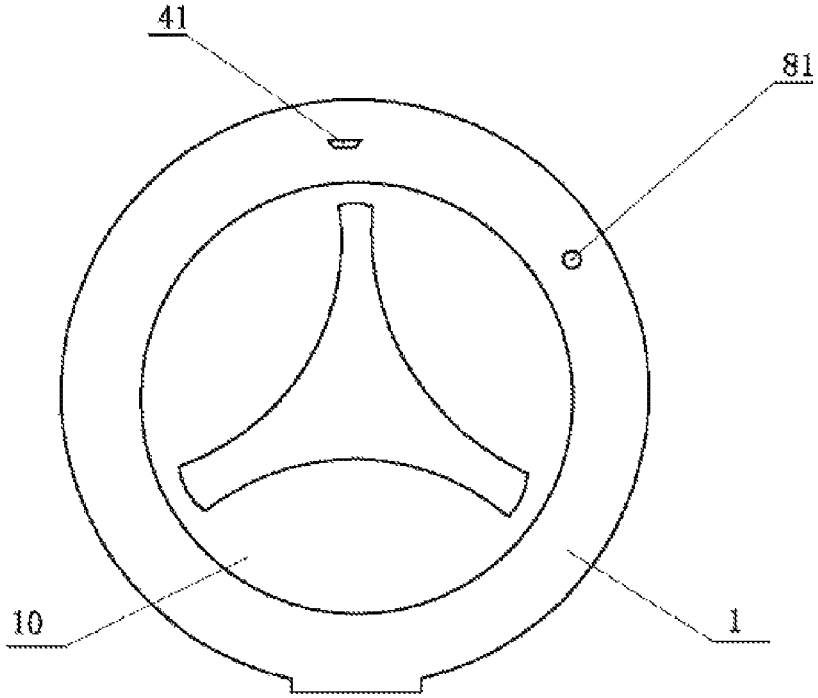
FIG. 2 is a rear view schematic diagram of structure of the embodiment 1 of the present invention.

See FIG. 1 and FIG. 2, to make the plate jacket to have a good elastic contracting function, the plate jacket comprises at least three arc-shaped protruding plates distributed evenly surrounding outside of inner ring wall of the circular main body.

Embodiment 4

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

Figure 5:
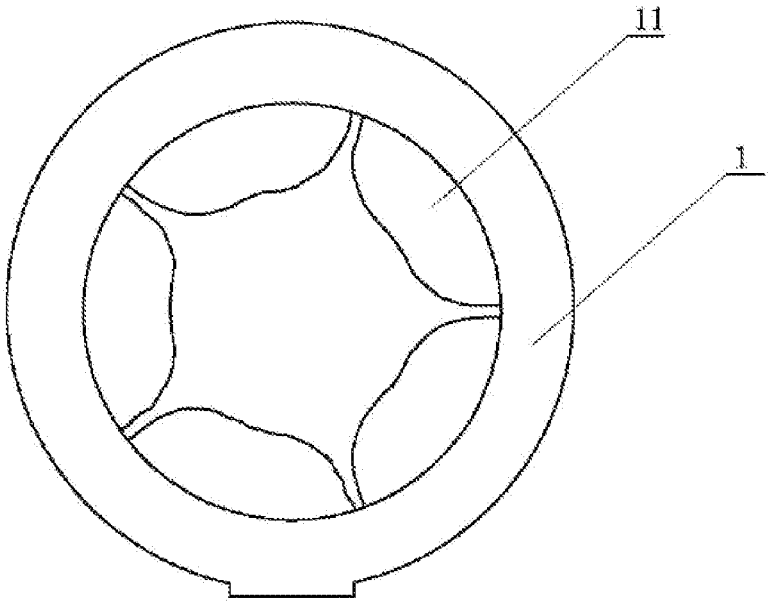
FIG. 5 is a front view schematic diagram of structure of the embodiment 4 of the present invention.

See FIG. 5, in this embodiment, the plate jacket comprises five arc-shaped protruding plates 11 evenly distributed surrounding inner sidewall of the circular main body, which has both attractive appearance and practicality.

The plate jacket can be provided on the inner sidewall of the circular main body by means of bonding. Specifically, after molding the circular main body, the plate jacket is connected on the inner ring sidewall of the circular main body by means of bonding.

Embodiment 5

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

The circular main body comprises a main body upper casing and a main body lower casing, and the joint part of the main body upper casing and the main body lower casing is provided with a card slot, and the plate jacket is stuck on the inner ring wall of the circular main body by the card slot on the main body upper casing and the main body lower casing.

In this embodiment, the card slot can be configure into a whole card slot along the inner sidewall of the main body upper casing, or can also be configured by segment along the inner sidewall of the main body upper casing; correspondingly, a card slot is also configured on the inner sidewall of the main body lower casing correspondingly; in this embodiment, the card slot is configured by segment. After the main body upper casing and the main body lower casing are connected, the plate jacket can be stuck on the inner sidewall of the circular main body by the card slot on the main body upper casing and the main body lower casing.

Embodiment 6

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

See FIG. 2 and FIG. 3, a connector 41 of the USB interface, a loudspeaker hole 61 and a microphone hole 81 are provided on outer ring wall of the circular main body respectively. In this embodiment, the connector of the USB interface is provided on the lower surface of the circular main body, the loudspeaker hole is provided on the outer ring wall of the circular main body, and the microphone hole is provided on the lower surface of the circular main body.

Embodiment 7

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

Figure 6:
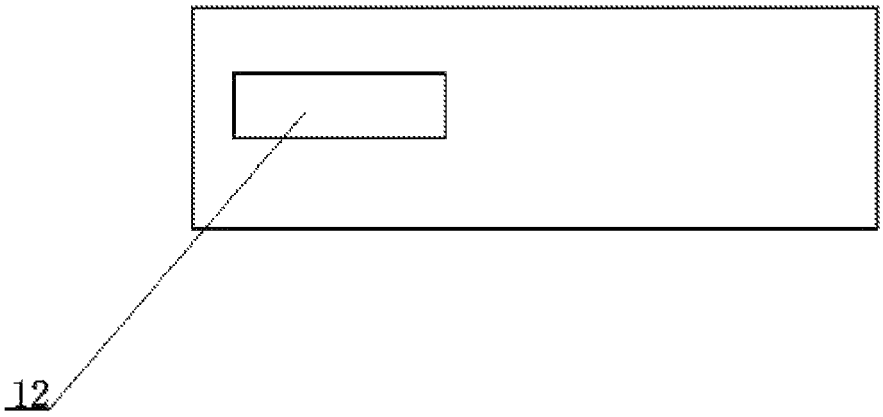
FIG. 6 is a side view schematic diagram of structure of the embodiment 7 of the present invention.

See FIG. 6, as a further improvement of the present invention, a digital display screen (LCM) can also be connected on the microcomputer control circuit, and a digital display screen (LCM) 12 is provided on the circular main body. The digital display screen LCM is connected with the main control circuit MCU, which can display playing file name and search files in the memory. See FIG. 4, in this embodiment, the digital display screen is provided on the sidewall of the circular main body.

Embodiment 8

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

Figure 4:
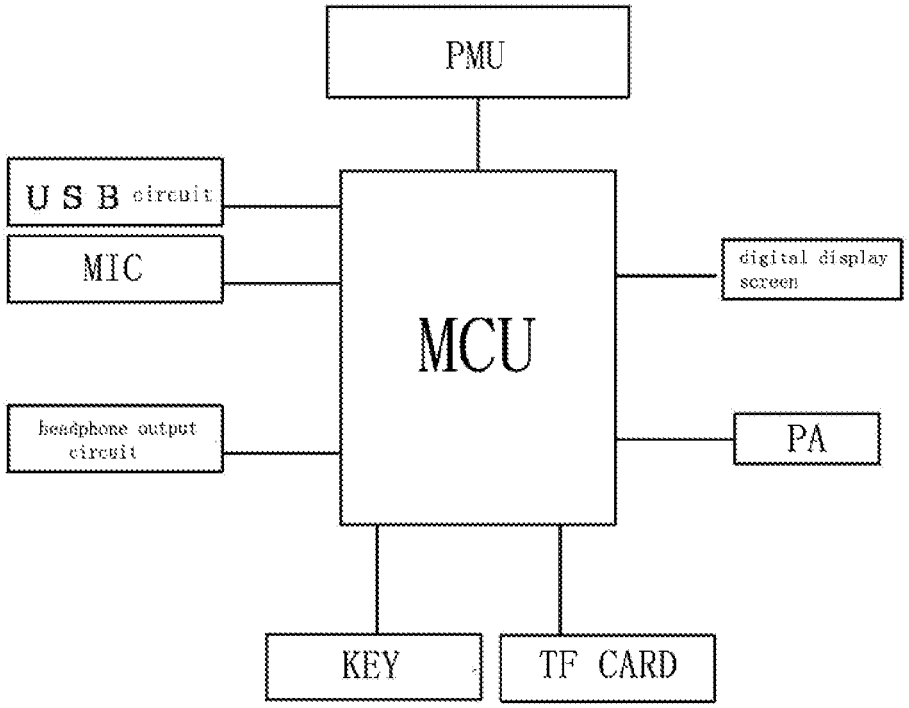
FIG. 4 is a connection diagram of component structure of the embodiment 1 of the present invention.

See FIG. 4, as a further improvement of the present invention, an earphone output circuit (EARPHONE) can also be connected on the microcomputer control circuit, and the earphone output circuit is designed by adopting the standard earphone interface, which can realize the interchange between the playing mode of earphone and the playing mode of loudspeaker; an earphone jack is provided on the circular main body. The earphone jack can be provided on the lower surface of the circular main body, or also can be provided on the upper end surface of the circular main body, and or can be provided on the sidewall of the circular main body as well.

Embodiment 9

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

The present embodiment is improved on the basis of embodiment 1, please understand the part identical with embodiment 1 in the present embodiment by referring to content disclosed in the embodiment 1, as the content disclosed in the embodiment 1 should also be considered as the content of this embodiment, and will not be described repeatedly herein.

Button of the present invention is a touch button, and a mounting opening 51 of the touch button is provided on the circular main body. See FIG. 2, the mounting opening of the touch button described in the embodiment is provided on the upper end surface of the circular main body. The mounting opening of the touch button also can be provided on the sidewall of the circular main body.

Embodiment 10

The present embodiment is improved on the basis of embodiment 1, please understand the part identical with embodiment 1 in this embodiment by referring to content disclosed in the embodiment 1, as the content disclosed in the embodiment 1 should also be considered to be content of this embodiment, and will not be described repeatedly herein.

The button is a protruding button.

The intelligent bracelet of the present invention also can simply provide a protruding button, and the protruding button is connected with the microcomputer control processor; at least 2 described manual buttons are provided, in which one manual button controls music playing, and the other manual button controls recording operation; a plurality of manual buttons also can be provided to realize the functions such as music playing, song selecting, forward and backward, and recording respectively. In this embodiment, the number of the protruding button is five.

The invention claimed is:

1. An intelligent bracelet for attracting a baby's attention, comprising a circular main body, in which a microcomputer controlled circuit is provided, and an USB interface, a button, a loudspeaker, a microphone and a memory are connected by the microcomputer control circuit, characterized in that, the inner ring sidewall of the circular main body is surrounded by a plate jacket with protrusion; the said plate jacket has a jacket hole in its central part, and the plate jacket is a plate jacket of elastic material with a thickness greater than 2 mm.

2. An intelligent bracelet for attracting a baby's attention of claim 1, characterized in that, the elastic material plate is a silicone rubber plate.

3. An intelligent bracelet for attracting a baby's attention of claim 1, characterized in that, the plate jacket comprises at least three arc-shaped protruding plates distributed evenly surrounding the inner sidewall of the circular main body.

4. An intelligent bracelet for attracting a baby's attention of claim 1, characterized in that, the plate jacket comprises five arc-shaped protruding plates distributed evenly surrounding the inner sidewall of the circular main body.

5. An intelligent bracelet for attracting a baby's attention of claim 1, characterized in that, the circular main body comprises a main body upper casing and a main body lower casing, and the joint part between the main body upper casing and the main body lower casing is provided with a card slot, and the main body upper casing and the main body lower casing snaps the plate jacket on the inner sidewall of the circular main body by the card slot.

6. An intelligent bracelet for attracting a baby's attention of claim 1, characterized in that, a connector of the USB interface, a loudspeaker hole and a microphone hole are provided on outer ring wall of the circular main body respectively.

7. An intelligent bracelet for attracting a baby's attention of claim 1, characterized in that, a display circuit is also connected on the microcomputer control circuit, and a digital display screen is also provided on the circular main body.

8. An intelligent bracelet for attracting a baby's attention of claim 1, characterized in that, an earphone output circuit is also connected on the microcomputer control circuit, and an earphone jack is provided on the circular main body.

9. An intelligent bracelet for attracting a baby's attention of claim 1, characterized in that, the button is a touch button, and a mounting opening of the touch button is provided on the circular main body.

10. An intelligent bracelet for attracting a baby's attention of claim 1, characterized in that, the button is a protruding button.

* * * * *